US005809599A

United States Patent [19]

Frazer

[11] Patent Number: 5,809,599

[45] Date of Patent: Sep. 22, 1998

[54] COMPOUND PLIERS TOOL WITH LINKED HANDLES

[75] Inventor: Spencer Frazer, Edmonds, Wash.

[73] Assignee: SOG Specialty Knives, Inc., Lynnwood, Wash.

[21] Appl. No.: 761,428

[22] Filed: Dec. 6, 1996

Related U.S. Application Data

[63] Continuation of Ser. No. 479,469, Jun. 7, 1995, abandoned, which is a continuation-in-part of Ser. No. 292,578, Aug. 19, 1994, abandoned, which is a continuation-in-part of Ser. No. 158,894, Nov. 29, 1993, abandoned.

[51] Int. Cl.[6] ..... B25B 7/22

[52] U.S. Cl. ..... 7/128; 7/129; 7/167; 81/427.5; 81/177.6; 81/177.4; 81/177.7; 30/153; 30/255

[58] Field of Search ..... 81/427.5, 177.2, 81/177.4, 177.6, 177.7, 415, 424, 303–307; 30/255, 153, 47, 233; 7/118, 167, 168, 125–135

[56] References Cited

U.S. PATENT DOCUMENTS

| | | | |
|---|---|---|---|
| D. 137,408 | 3/1944 | Frisk . | |
| D. 244,987 | 7/1977 | Lavitch | D8/99 |
| D. 286,501 | 11/1986 | Magan | D8/105 |
| D. 338,386 | 8/1993 | Frazer | D8/105 |
| 580,235 | 4/1897 | Strum . | |
| 586,849 | 7/1897 | Ibelli . | |
| 589,392 | 8/1897 | Kolar . | |
| 596,096 | 12/1897 | Watts . | |
| 614,537 | 11/1898 | Dahlquist . | |
| 649,334 | 5/1900 | Meloos . | |
| 662,005 | 11/1900 | Lewis . | |
| 790,432 | 5/1905 | Heilrath . | |
| 857,459 | 6/1907 | Hendrickson . | |
| 896,746 | 8/1908 | McCarty . | |
| 1,184,746 | 5/1916 | Hanson . | |
| 1,370,906 | 3/1921 | Newton . | |
| 1,467,661 | 9/1923 | Undy . | |
| 1,511,340 | 10/1924 | Jackson . | |
| 1,524,694 | 2/1925 | Maio . | |
| 1,561,993 | 11/1925 | Nielsen . | |
| 1,811,982 | 6/1931 | Soustre . | |
| 2,575,652 | 11/1951 | Bovee | 81/43 |
| 3,798,687 | 3/1974 | Stevens | 7/5.1 |
| 3,858,258 | 1/1975 | Stevens | 7/5.1 |
| 4,122,569 | 10/1978 | Hitchcock | 7/134 |
| 4,238,862 | 12/1980 | Leatherman | 7/128 |
| 4,502,220 | 3/1985 | Aoki | 30/154 |
| 4,512,051 | 4/1985 | Magan | 7/128 |
| 4,563,833 | 1/1986 | Aucoin | 43/54.1 |
| 4,744,272 | 5/1988 | Leatherman | 81/427.5 |
| 4,888,869 | 12/1989 | Leatherman | 30/161 |
| 5,029,355 | 7/1991 | Thai | 7/118 |
| 5,062,173 | 11/1991 | Collins et al. | 7/118 |
| 5,142,721 | 9/1992 | Sessions et al. | 7/128 |
| 5,212,844 | 5/1993 | Sessions et al. | 7/128 |
| 5,267,366 | 12/1993 | Frazer | 7/128 |

FOREIGN PATENT DOCUMENTS

| | | |
|---|---|---|
| 30788 | 8/1884 | Germany . |
| 277412 | 8/1951 | Switzerland . |
| 17248 | 9/1895 | United Kingdom . |
| 112111 | 12/1917 | United Kingdom . |

*Primary Examiner*—D. S. Meislin
*Attorney, Agent, or Firm*—Christensen, O'Connor, Johnson & Kindness PLLC

[57] ABSTRACT

Cooperating jaws are pivoted together such that working end portions of the jaw members are movable toward and away from each other. The jaws have butt portions extending opposite the jaw pivot from the working end portions. Such butt portions are, in turn, pivoted to elongated handles for swinging about axes parallel to the axis of the jaw pivot. The handles are channel shaped and define recesses into which the interconnected jaw members can be swung so as to be nested in the handles or, alternatively, into which the interconnected jaw members can be retracted so as to be partially contained within the handles. The handles have forward portions interconnected by a link which, in an open position of the handles, is positioned between the handle pivots and the jaw pivot. For a given angle of swing of the handles, the jaws are moved through a smaller angle, i.e., a substantial mechanical advantage is obtained.

5 Claims, 11 Drawing Sheets

COMPOUND PLIERS TOOL WITH LINKED HANDLES

RELATION TO PRIOR APPLICATION

This application is a continuation application of prior application Ser. No. 08/479,469, filed on Jun. 7, 1995, which is a continuation-in-part of Ser. No. 08/292,578, filed Aug. 19, 1994, which in turn is a continuation-in-part of Ser. No. 08/158,894, filed on Nov. 29, 1993, all abandoned.

BACKGROUND OF THE INVENTION

Leatherman U.S. Pat. No. 4,744,272, issued May 17, 1988, discloses a "Foldable Tool" including pliers jaws having respective tangs or butt portions remote from the cooperating work or grasping end portions of the jaws. The butt portions are pivoted to channel-shaped handles. The pivots for the jaws and handles are parallel. The handles are swingable relative to the jaws for compact nesting of the jaws within the handles. Pocket knife implements can be separately pivoted to the channel-shaped handles.

Other types of compound tools having cooperating jaws swingable relative to handles are disclosed in German Patentschrift 30788, published Aug. 14, 1984, and in the following U.S. patents: Meloos, Pat. No. 649,344, issued May 8, 1900; Di Maio, Pat. No. 1,524,694, issued Feb. 3, 1925; Leatherman Pat. No. 4,238,862, issued Dec. 16, 1980; Leatherman Pat. No. 4,888,869, issued Dec. 26, 1989; and Collins et al., Pat. No. 5,062,173, issued Nov. 5, 1991.

Yet another compound tool having cooperating pliers jaws swingable relative to handles is disclosed in my U.S. patent application Ser. No. 07/891,990, filed May 27, 1992, and issued on Dec. 7, 1993 as U.S. Pat. No. 5,267,366.

In the tools of the patents and application referred to above, the handles of the tools normally form extensions of the butt portions of the jaws, and the handles usually are longer than the grasping or working end portions of the jaws. In order to achieve a mechanical advantage, the handles must be grasped at their end portions remote from the jaws. Nevertheless, such tools often are formed with handles shorter than the handles of standard tools, for compactness when the jaws are swung or otherwise retracted into the handles. Therefore, the mechanical advantage that can be achieved is limited.

SUMMARY OF THE INVENTION

The present invention provides a multipurpose tool having cooperating jaw members pivoted together such that working end portions of the jaw members are movable toward and away from each other. The jaw members have tang or butt portions extending opposite the jaw pivot from the working end portions. Such butt portions are, in turn, pivoted to elongated handles for swinging about axes parallel to the axis of the jaw pivot. Alternatively, the butt portions of the jaws are slidably interconnected with the handles. The handles are channel-shaped and define recesses into which the interconnected jaw members can be swung or retracted so as to be nested in the handles.

More specifically, in the "open" position of the tool, the handles form extensions of the jaw members and have forward ends adjacent thereto and rear ends remote therefrom. The tool can be "closed" by swinging the handles away from each other. The handles are moved relative to the jaws through angles approaching 180° in order to receive the jaw members within the handles. Alternatively, the tool can be closed by slidably retracting the jaws into the interior of the handle channels.

In accordance with the present invention, a short link interconnects the forward end portions of the handles. Such link is positioned between the jaw pivot and the handle pivots when the tool is open. The result is that the jaws are swung through a relatively small angle when the handles are swung through a larger angle, thereby increasing the mechanical advantage obtained when using the tool.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention provides a tool of the type having cooperating jaw members pivoted to opposing handles. The handles are swingable relative to each other and are movable relative to the jaw members for compact nesting of the jaw members in the handles. In addition, the handles can carry a variety of pocketknife implements each of which can be swung relative to its handle between a projected working position and a closed position retracted into the handle.

Figure 1:
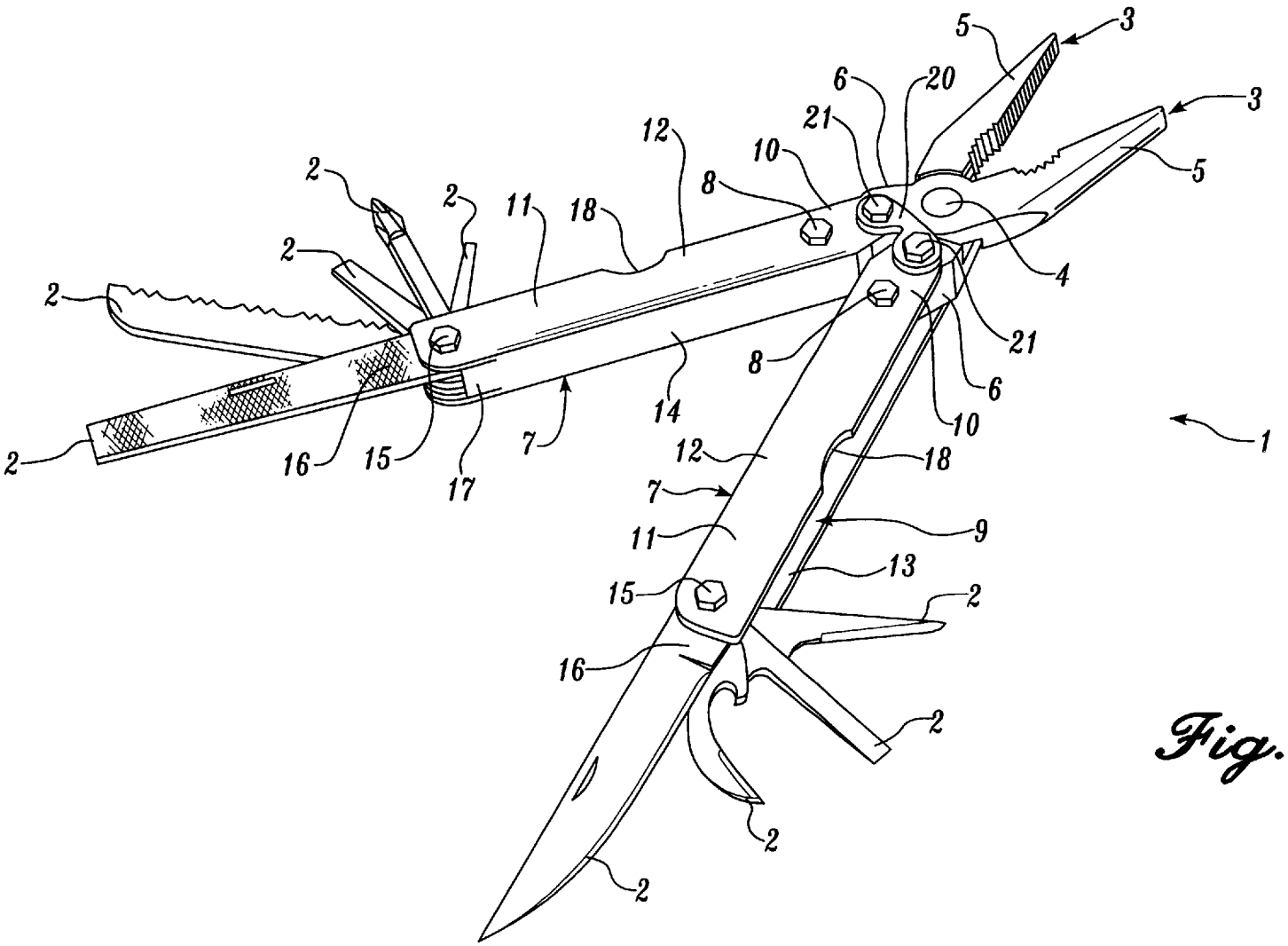
FIG. 1 is a top perspective of a compound pliers tool with linked handles in accordance with the present invention, including cooperating jaw members pivotally connected to a pair of handles.

FIG. 1 illustrates a compound pliers tool 1 in accordance with the present invention with each of the pocketknife implements 2 projected or partially projected. Such tool 1 includes opposing jaw members 3 connected by a pivot 4. The working end portions 5 of the jaw members are swingable toward and away from each other about the axis of the pivot. In the preferred embodiment, the jaw members are pliers jaws.

The butt portions 6 of the jaws extend from the pivot 4 in a direction opposite the direction that the working end portions 5 project from the pivot. The butt portions are connected to handles 7 by pivots 8 that extend parallel to the jaw pivot 4. Each handle defines a channel 9 which opens outward, away from the channel of the other handle when the tool is in the open condition illustrated in FIG. 1. In such open condition of the tool, the handles 7 appear to form extension of the jaw members 3.

Each handle 7 has a leading or forward end portion 10 projecting from its pivot 8 generally toward the opposing jaw members 3 and a trailing or rear end portion 11 projecting from its pivot generally away from the jaw members. In addition, each handle includes a top plate 12, a bottom plate 13, and an inner upright web 14 extending between such plates. The pocketknife implements 2 are swingable between retracted positions fitted between the handle top and bottom plates 12 and 13 and working positions projected from the handles. More specifically, the pocketknife implements have root portions 16 swingably connected to the rear end portions 11 of the handles by upright pivots 15. Pivots 15 are parallel to the jaw pivot 4 and the handle pivots 8. The root portion 16 of each implement 2 is engaged by a leaf spring 17 formed as an extension of the vertical web 14 connecting the corresponding top and bottom plates 12 and 13. The leaf spring also can limit the degree to which an implement can be swung to its open position. One or more of the top and bottom plates 12 and 13 can have a finger notch 18 for access to edge portions of the implements when they are retracted.

Handles 7 are swingable relative to the jaw members 3 about the axes of the pivots 8. In accordance with the present invention, the leading end portions 10 of the handles are interconnected by a short link 20 extending over the top plates 12 of the handles. Link 20 has its opposite ends connected to the front end portions 10 of the handles by short pivot pins 21. In the open condition of the tool 1 illustrated in FIG. 1, link 20 is positioned between the jaw pivot 4 and the handle pivots 8.

Figure 2:
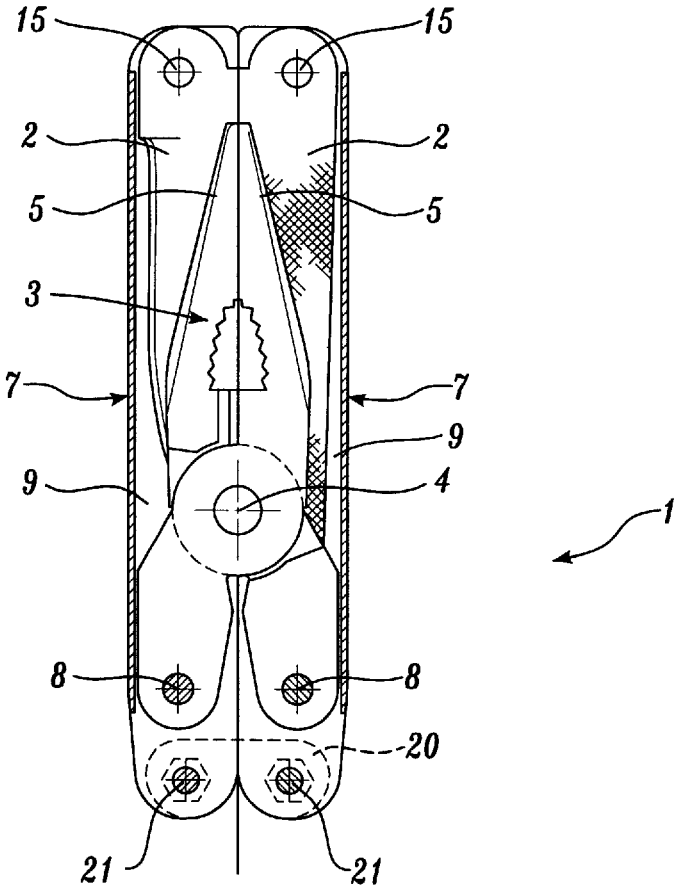
FIG. 2 is a top plan of the tool of FIG. 1 with parts broken away, illustrating the closed condition of the tool with the jaw members nested in the handles.

Each handle 7 is freely swingable through an angle approaching 180° about the axis of its pivot 8 from the open condition of the tool illustrated in FIG. 1 to the closed condition shown in FIG. 2. As seen in FIG. 2, in such closed condition the jaw members 3 are received in the channels 9 of the handles between the handle top and bottom plates. The pocketknife implements 2 are arranged in the channels so that they do not interfere with nesting of the jaw members. Preferably, in the closed condition of the tool illustrated in FIG. 2, the inner edges of the handles are closely adjacent, as are the facing surfaces of the working end portions 5 of the jaw members.

Figure 3:
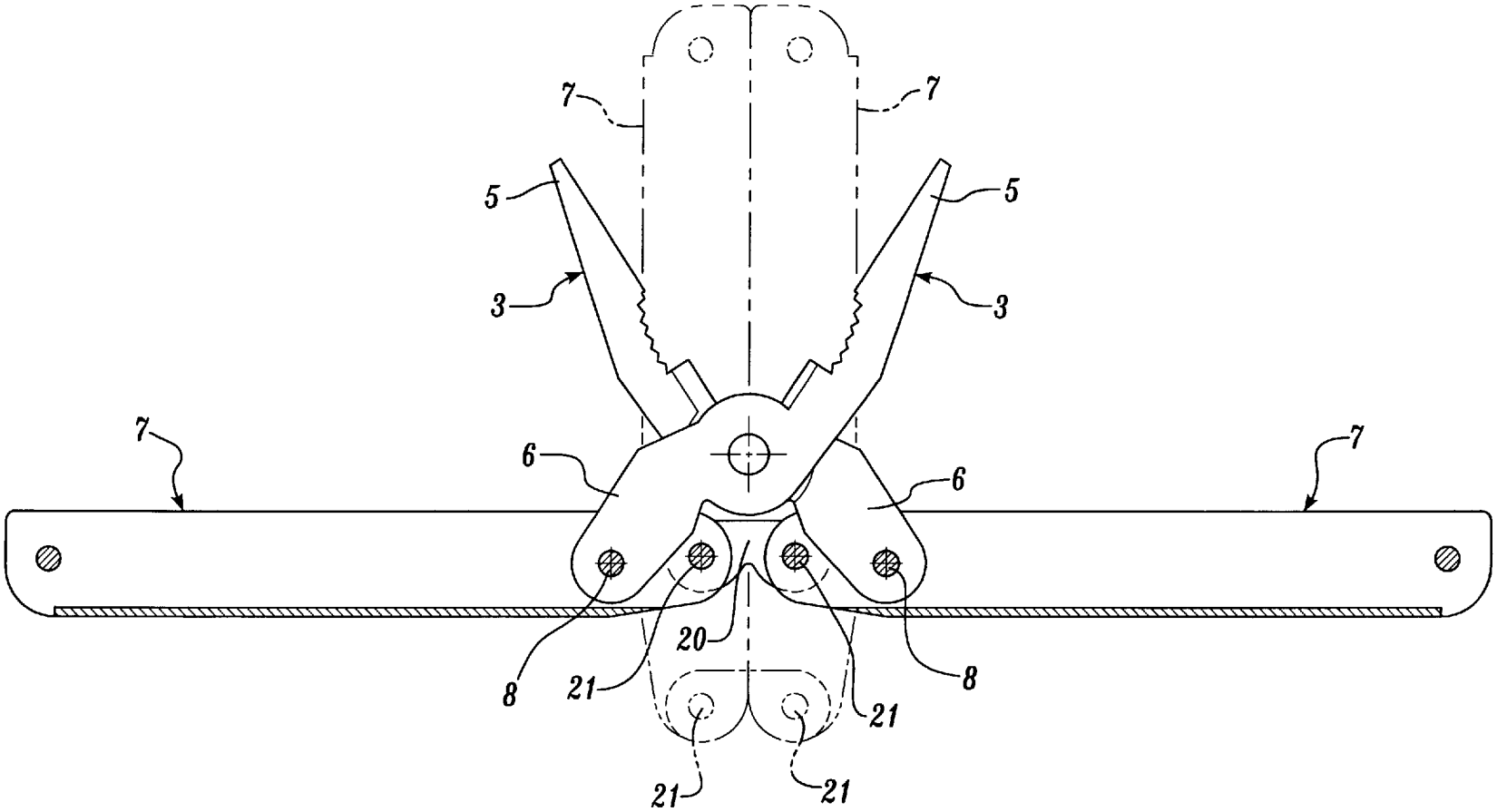
FIG. 3 is a top plan corresponding to FIG. 2, but with parts in different positions, illustrating an intermediate condition of the tool with the jaw members and the handles spread apart.
Figure 4:
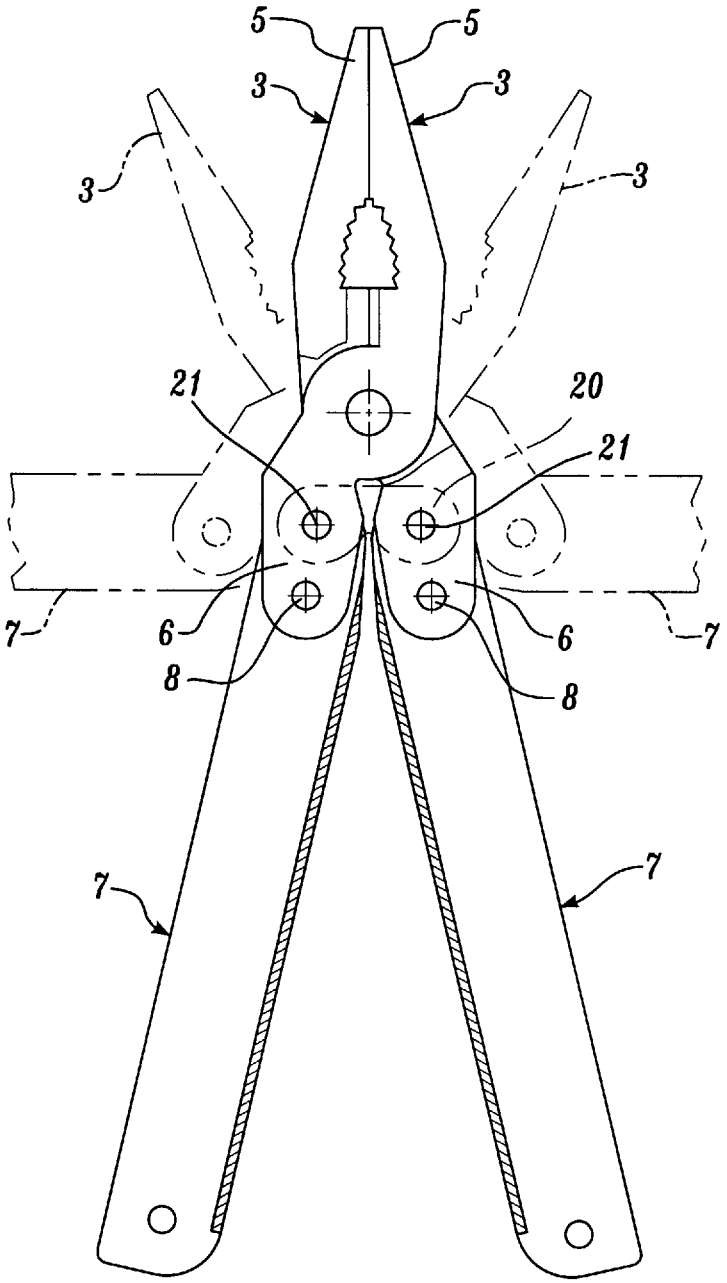
FIG. 4 is a top plan corresponding to FIGS. 2 and 3, with parts in different positions, illustrating the open condition of the tool with the handles forming extensions of the jaw members.

FIG. 3 and 4 illustrate the relative positions of the jaws 3, link 20 and handles 7 as the tool is opened. With reference to FIG. 3, as the handles 7 are swung away from each other from the closed position illustrated in broken lines, the handle pivots 8 travel in circular arcs centered about the associated link pivots 21. When each handle has been swung through an angle of 90° to the solid line position illustrated in FIG. 3, pivots 8, which control the positions of the jaw butt portions 6, are at their maximum distance from each other so that the working end portions 5 of the jaws 3 are at their most spread apart positions. With reference to FIG. 4, as the handles 7 continue to be swung away from the jaws 3, the handle pivots 8 and, consequently, jaw portions 5 are moved toward each other. The result is that the working end portions 5 of the jaws 3 are closed. Preferably, in the fully "open" condition of the tool illustrated in solid lines in FIG. 4, the handles still diverge from each other at a small acute angle even though the working end portions 5 of the jaws are in engagement, so that the strong grasping force can be continued to be supplied to the jaws.

In a tool in accordance with the present invention, i.e., having handles linked as described above, the mechanical advantage achieved by swinging the handles no longer is a function of only the relative length of the handles as compared to the length of the working end portions of the jaws. Rather, the handles are swung through relatively large angles while the jaws are swung through a smaller angle. For example, with reference to FIG. 3, in the illustrated embodiment when each handle is swung through an angle of 90° from the broken line position of FIG. 3 to the solid line portion, the jaws are swung through an angle of less than 45°. The actual mechanical advantage achieved is a function of the location of the handle pivots 8 along the circular arc centered about the corresponding link pivot 21. In the solid line position shown in FIG. 3, the handle pivots would move toward other only slightly for a given angle of swing of the handles, and a large mechanical advantage is achieved. As the handles approach the solid line position shown in FIG. 4, the handle pivots 8 move toward or away from each other to a greater degree for the same swing angle, although still much less than the angle through which the jaws are swung. The length of the handles, the relative positions of the jaw pivots and the link pivots, the length of the jaw butt portions, and the length of the jaw working end portions all can be selected to achieve a desired mechanical advantage depending on the particular application.

Figure 5:
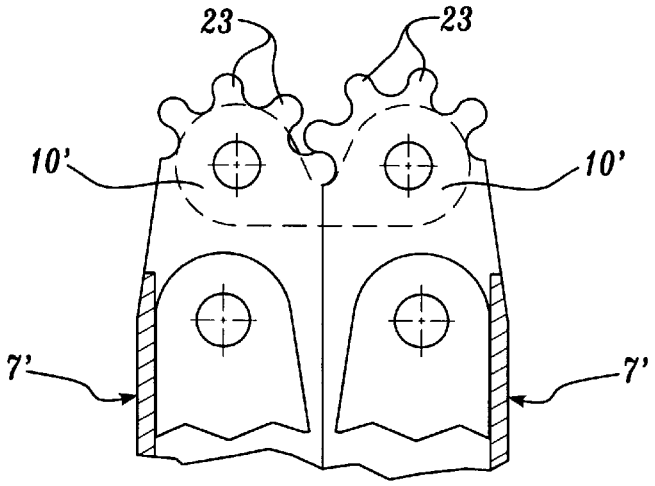
FIG. 5 is an enlarged fragmentary top plan of a modified compound pliers tools with linked handles in accordance with the present invention.
Figure 6:
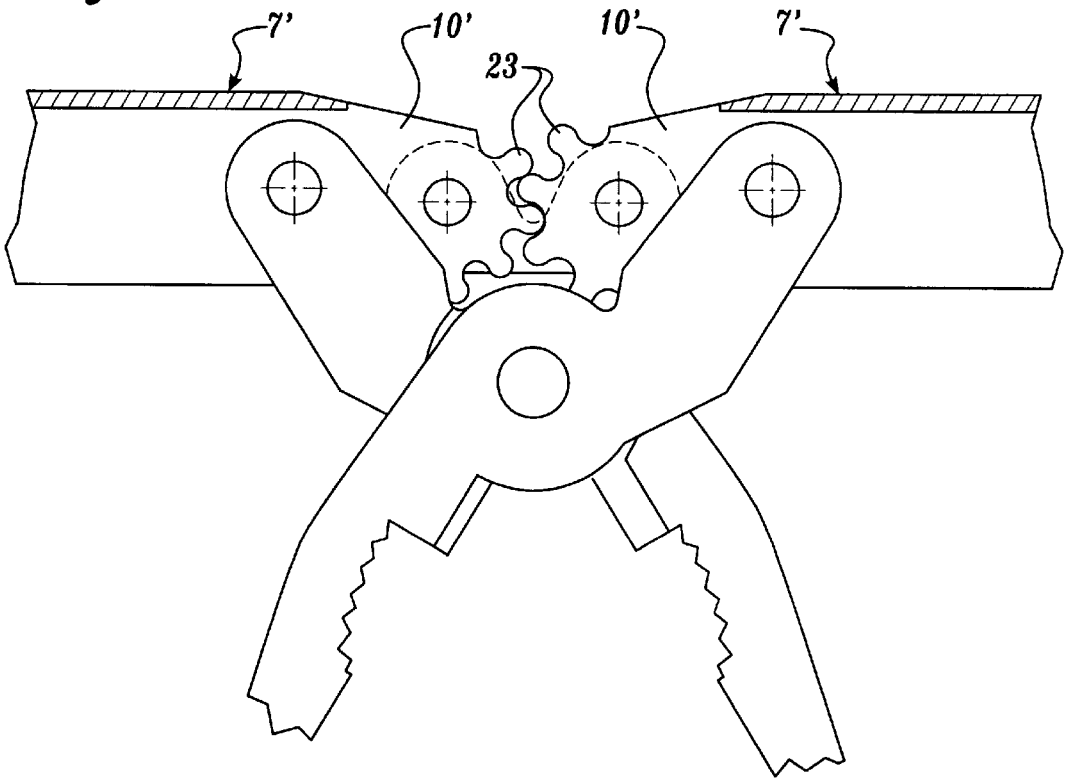
FIG. 6 is an enlarged fragmentary top plan of the modified tool of FIG. 5 with parts in different positions.

FIGS. 5 and 6 illustrate a modification for the tool with linked handles in accordance with the present invention. In the modified form, the leading end portions 10' of the handle top and/or bottom plates have rounded gear teeth or fingers 23 designed to interdigitate as the handles 7' are swung relative to each other. In that case, the handles always will swing together through the same angle. FIG. 5 illustrates the closed position of the modified tool whereas FIG. 6 illustrates the partially open position. In all other respects, the modified form of the invention shown in FIGS. 5 and 6 is identical to the form shown in FIGS. 1–4.

Figure 7:
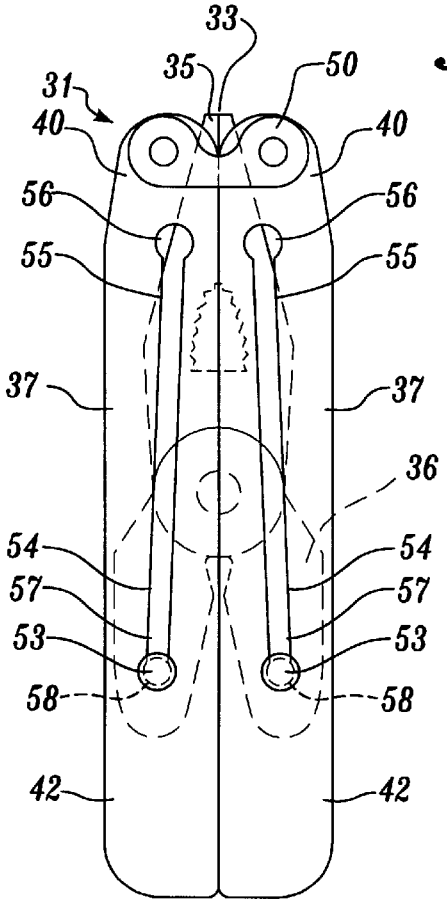
FIG. 7 is a top plan of another modified compound pliers tool with linked handles in accordance with the present invention, illustrating the closed condition of the tool with the jaw members slidably retracted into the handles.
Figure 8:
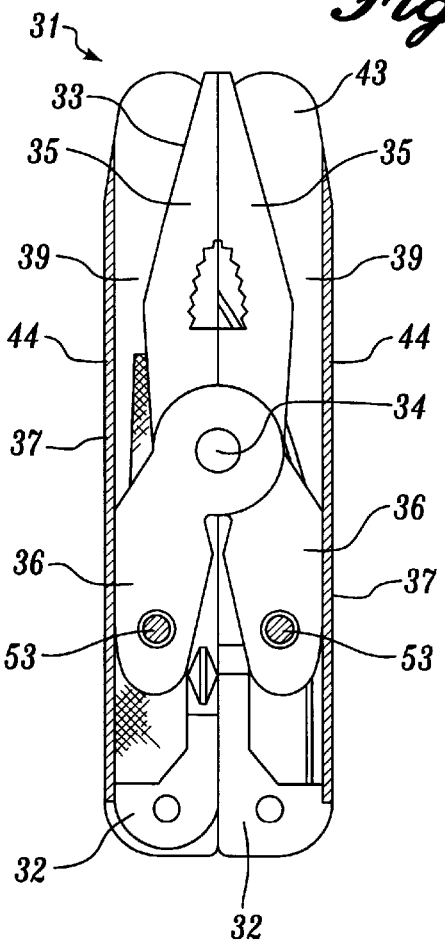
FIG. 8 is a top plan corresponding to FIG. 7, but with parts broken away.

In the modified tool 31 illustrated in FIGS. 7–14, the jaw members 33 are slidably retractable for partial containment of the jaw members in the handles 37 in the closed condition shown in FIGS. 7 and 8. In such closed condition the jaw members 33 are received in the channels 39 of the handles 37 between the top and bottom plates 42 and 43. The pocketknife implements 32 are arranged in the channels 39 so that they do not interfere with retracting of the jaw members 33.

The butt portions 36 of the jaw members are connected to the handles 37 by fasteners 53 that extend parallel to the jaw pivot 34. The top plate 42 of each handle has a linear slot 54 which extends along the axis of the handle. The forward end portion 55 of the slot includes an aperture 56 for receiving the fastener 53 in the open position. Similarly, the rear end portion 57 of the slot 54 can include a second aperture 58 for receiving the fastener 53 in the closed position. In addition, each channel 39 opens inward, toward the channel of the other handle and away from the outer upright web 44 extending between the top and bottom plates of the handle.

The fasteners 53, and hence jaw members 33, are slidable relative to the handles along the slot 54. In accordance with the present invention, a short link 50 extends over the top plates 42 of the handles and connects the leading end portions 40 of the handles. IN the closed position shown in FIG. 7, the working end portions 35 of the jaw members protrude partially from the channels of the handles.

Figure 9:
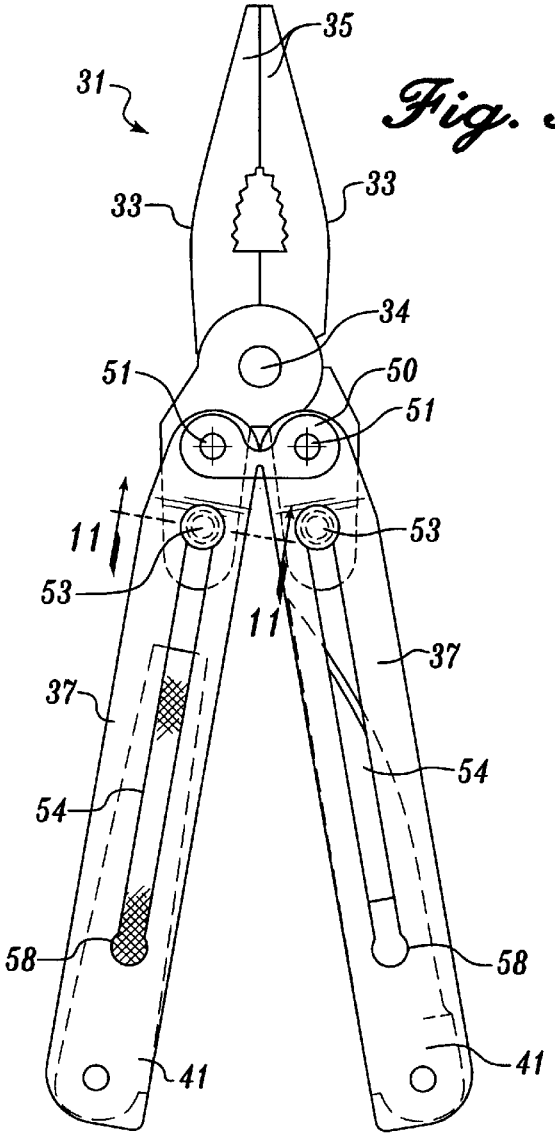
FIG. 9 is a top plan corresponding to FIG. 7, but with parts in different positions, illustrating the open condition of the tool with the handles forming extensions of the jaw members.
Figure 10:
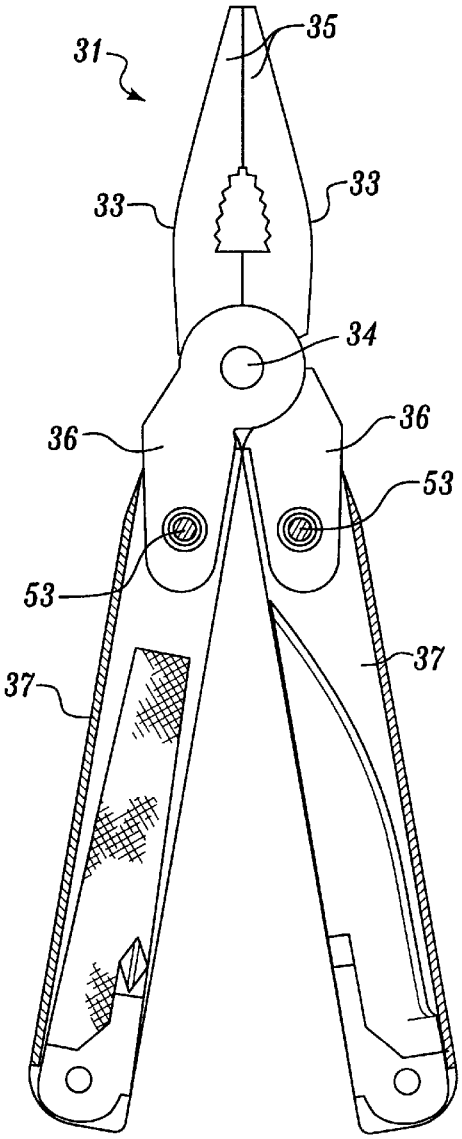
FIG. 10 is a top plan corresponding to FIG. 9, but with parts broken away.

FIGS. 9 and 10 illustrate the relative positions of the jaw members 33, link 30 and handles 37 when the tool is in the open position. Preferably, the handles 37 still diverge from each other at a small acute angle even though the working end portions 35 of the jaw members are in engagement, so that a strong grasping force can be continued to be supplied. With reference to FIG. 9, as the fasteners 53 are slidably moved along the slot 54 from the open position to the closed position, the rear end portions 41 of the handles converge because the longitudinal slots 54 extend at small angles relative to the longitudinal centerlines of the handles. In the preferred embodiment, the angle of each slot is 15° from the longitudinal centerline of the corresponding handle.

Figure 11:
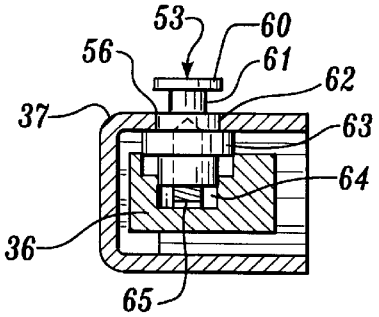
FIG. 11 is an enlarged fragmentary section taken along line 11—11 of FIG. 9.

FIG. 11 illustrates the fastener 53 for slidably coupling the butt portions 36 of the jaw members to the handles 37. The fastener includes a top head 60, a narrower stepped shank 61, 62, and a broader foot 63. The foot 63, which also can be stepped, fits in a blind bore 64 that opens through the top of the jaw member butt portion 36. The head 60 of the fastener lies outside the handle channel and is substantially circular in shape with a diameter at least slightly larger than the diameter of apertures 56 and 58. The top portion 61 of the stepped shank is substantially cylindrical with a diameter slightly less than the width of the central portion of the slot 54. The lower portion 62 of the shank is substantially cylindrical with a diameter slightly less than the diameters of the apertures 56 and 58.

A compression spring 65 is fitted between the base of bore 64 and the underside of the fastener foot 63 to bias the fastener upward. When registered with an aperture 56 or 58, the larger portion 62 of the fastener shank fits in the aperture. This position of the fastener prevents the jaw members from sliding with respect to the handles when the jaws are in the fully extended position shown in FIGS. 12 and 13. Nevertheless, the interconnection does not inhibit swinging of the handles relative to the jaw members about the upright axis of the fastener.

Figure 13:
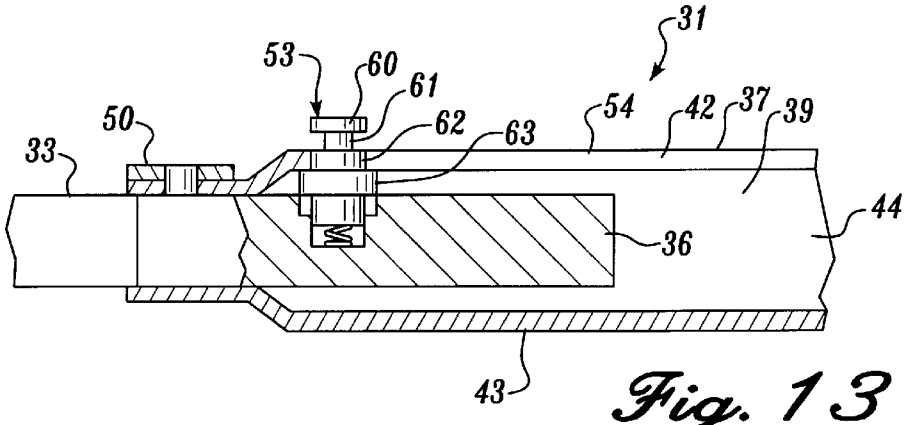
FIG. 13 is an enlarged fragmentary side elevation of the modified tool of FIG. 7, with parts broken away.
Figure 14:
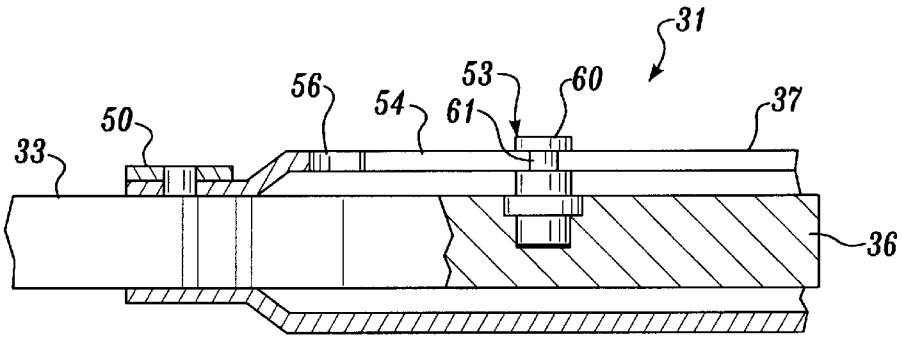
FIG. 14 is an enlarged fragmentary side elevation of the modified tool of FIG. 7, corresponding to FIG. 12, but with parts in different positions.

With reference to FIGS. 13 and 14, the jaw members can be moved from the fully extended position to the retracted position by applying a slight downward force to the head 60 of the fastener to overcome the spring bias, and then slidably moving the fastener toward the rear end of the handle along the longitudinal slot 54. When the jaws are not in the fully extended or fully retracted position, the fastener shank portion 61 rides in the longitudinal slot 54 as seen in FIG. 14. When the jaw members are fully retracted, the fastener pops up to the position shown in FIG. 11 so that the jaw members are held retracted until the fastener head is pushed down to allow the sliding movement of the jaw members in the handles.

Figure 12:
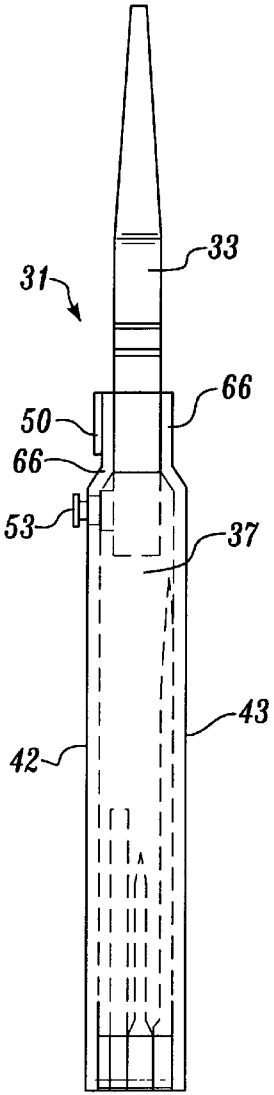
FIG. 12 is a side elevation of the modified tool of FIG. 7.

With reference to FIG. 12, the leading portions 66 of the handle top and bottom plates 42 and 43 converge to receive the jaw members 33 between them when the tool is "open." This provides a sturdier, more secure interconnection of the handles with the jaw members when the tool is used.

With reference to FIGS. 9 and 10, the geometry of the tool 31 when in the open condition is identical to the geometry of the first described embodiment, that is, the relative positions of the jaw pivot 34, link pivots 51, and handle pivots (fastener s 53) are the same. Consequently, the same mechanical advantage is achieved. The jaw members move through a smaller angle than the handles. In all other respects, the modified form of the invention shown in FIGS. 7–14 is identical to the form shown in FIGS. 1–4.

Figure 15:
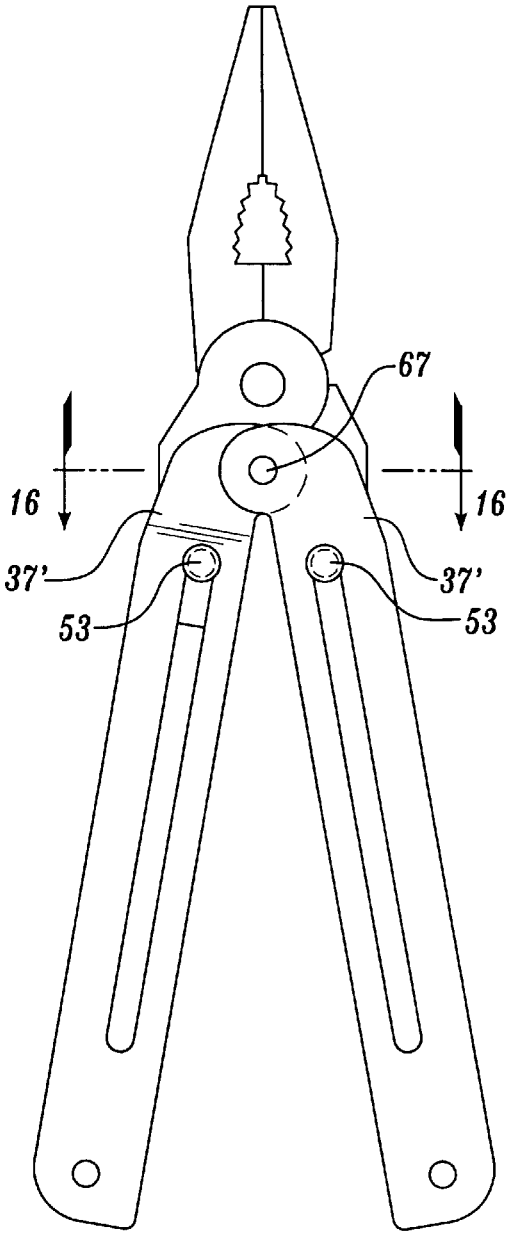
FIG. 15 is a top plan of another modified compound pliers tool with slidably retractable jaws, illustrating an alternative means for linking the handles.
Figure 16:
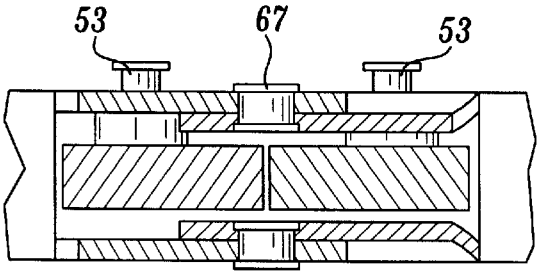
FIG. 16 is an enlarged fragmentary section taken along line 16—16 of FIG. 15.

FIGS. 15 and 16 illustrate a modification for the tool illustrated in FIGS. 7–14. In the modified form, the leading end portions of the handles 37' are curved inward and are interconnected by a pivot 67 that extends parallel to the jaw pivot 34. In the open condition of the tool illustrated in FIG. 15, pivot 67 is positioned between the jaw pivot 34 and the handle fasteners 53. In all other respects, the modified form of the invention shown in FIGS. 15 and 16 is identical to the form shown in FIGS. 7–14.

Figure 17:
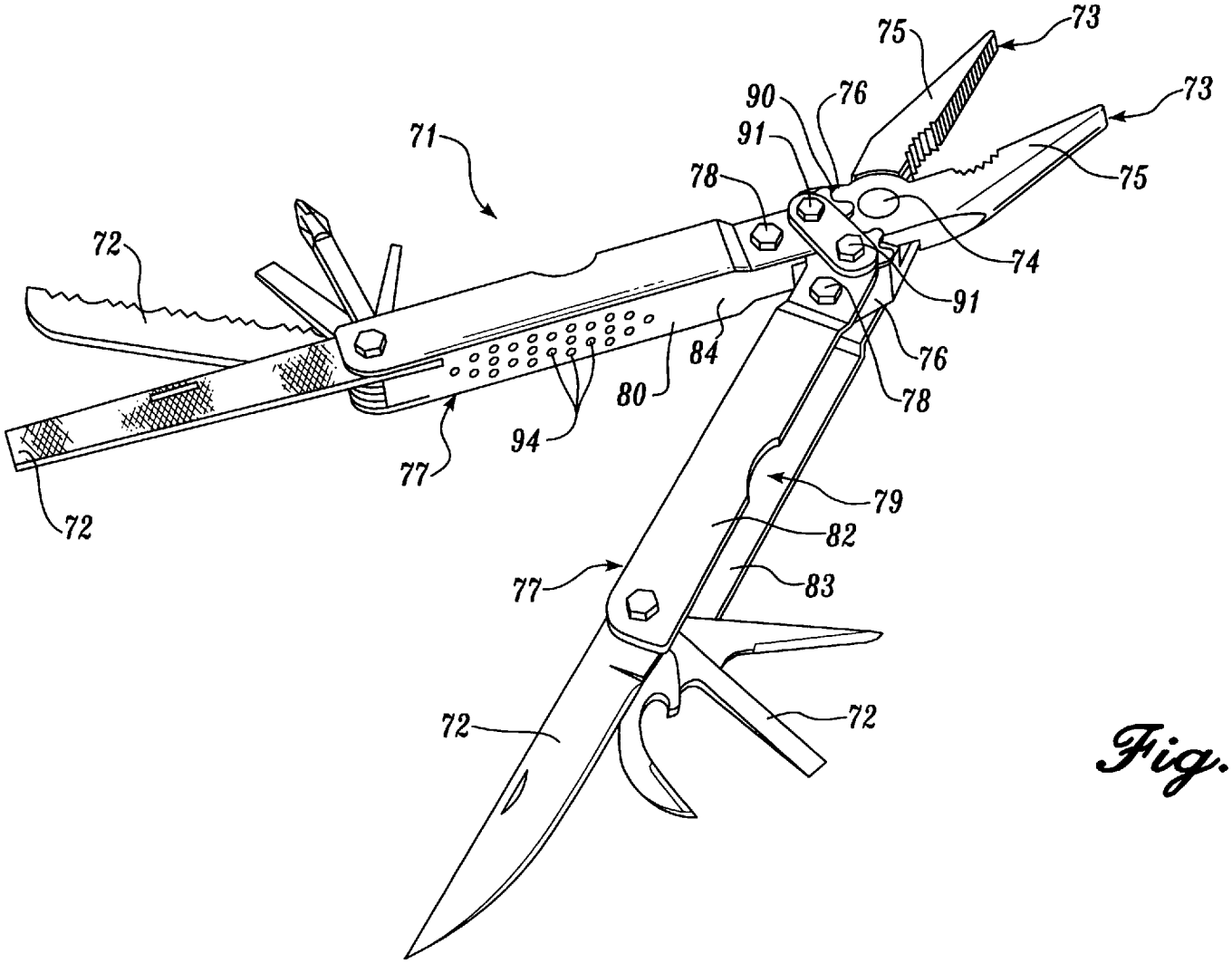
FIG. 17 is a top perspective of another modified compound pliers tool with linked handles in accordance with the present invention.
Figure 18:
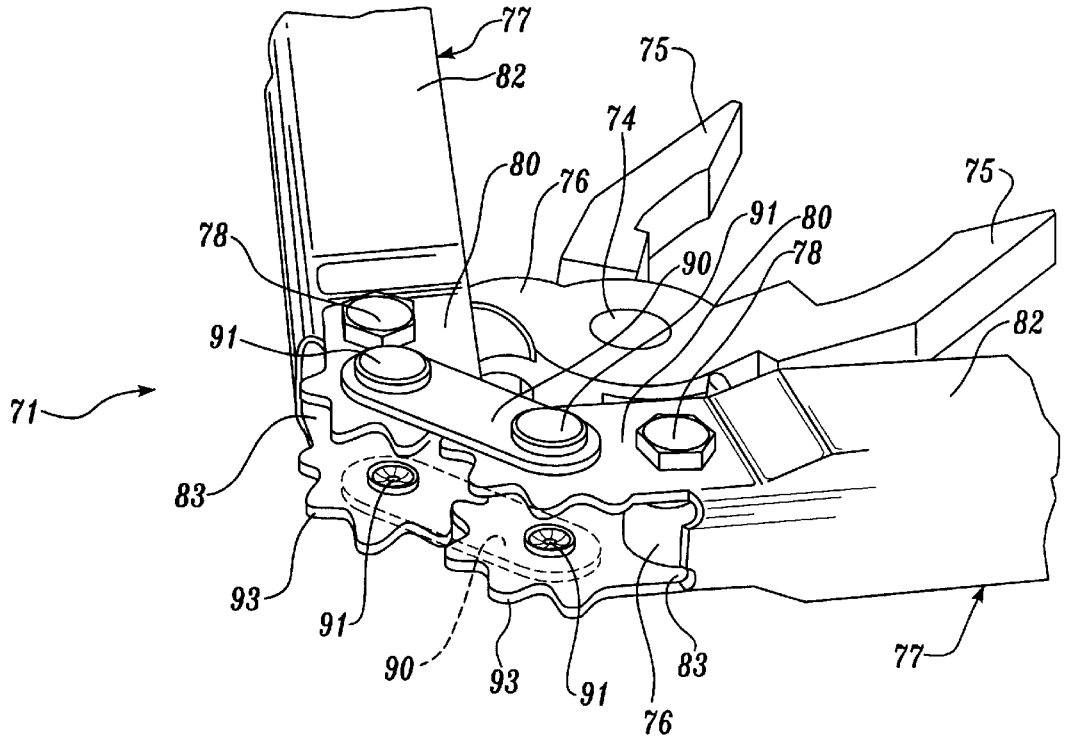
FIG. 18 is an enlarged fragmentary top perspective of the tool of FIG. 17, with parts in different positions.
Figure 19:
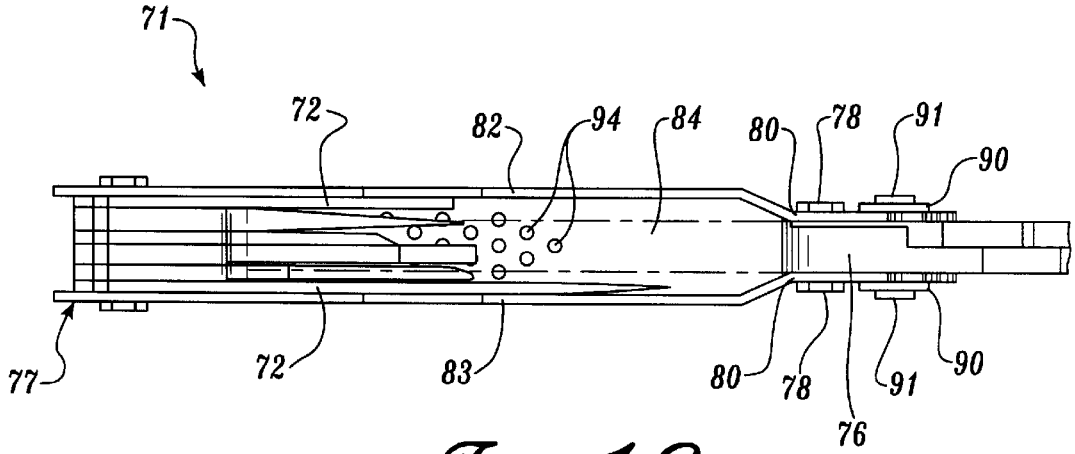
FIG. 19 is a side elevation of the tool of FIG. 17, with parts in different positions and parts broken away.

With reference to FIGS. 17, 18 and 19, the preferred embodiment of the tool 71 in accordance with the present invention has many of the features of the embodiments previously described. FIG. 17 illustrates the preferred embodiment with each of the pocket knife implements 72 projected or partially projected. Tool 71 includes opposing jaw members 73 connected by a pivot 74. The working end portions 75 of the jaw members are swingable toward and away from each other about the axis of the pivot. The butt portions 76 of the jaw members extend from the pivot 74 in a direction opposite the direction that the working end portions 75 project from the pivot. The butt portions are connected to handles 77 by pivots 78 that extend parallel to the jaw pivot 74. Each handle defines a channel 79 which opens outward, away from the channel of the other handle, when the tool is in the open condition illustrated in FIG. 17. In such open condition of the tool, the handles 77 appear to form extensions of the jaw members 73.

Each handle 77 has a leading or forward end portion 80 projecting from its pivot 78 generally toward the opposing jaw members 73, and a trailing or rear end portion projecting from its pivot generally away from the jaw members. In addition, each handle includes a top plate 82, a bottom plate 83, and an inner upright web 84 extending between such plates. The pocket knife implements 72 are swingable between retracted positions fitted between the handle top and bottom plates 82 and 83 and working positions projected from the handles. The connection of the pocket knife implements 72 to the rear end portions of the handles is the same as for the embodiment of the present invention shown in FIG. 1.

Handles 77 are swingable relative to the jaw members 73 about the axes of the pivots 78. In accordance with the present invention, the leading end portions 80 of the handles are interconnected by a short link 90 extending over the top plates 82 of the handles. The opposite end portions of the top link are connected to the top plates by short pivots 91. As seen in FIGS. 18 and 19, an identical link 90 extends below the handle bottom plates 83 between short bottom pivots 91. Preferably, the leading end portions 80 of both the top and bottom plates 82 and 83 are formed with rounded gear teeth 93 designed to interdigitate as the handles 77 are swung relative to each other. Thus, the handles always will swing together through the same angle. The jaw member butt portions 76 fit between the top and bottom plates 82 and 83, i.e., within the channels of the handles, as compared to the links 90 which are positioned outside the channels at the top and bottom.

As best seen in FIGS. 18 and 19, the leading end portions of the handle top and bottom plates 82 and 83 converge in the areas of the pivots 78 and 91. The jaw member butt portions 76 are closely embraced at such leading end portions. The rear portions of the channels defined between the top and bottom plates 82 and 83 are substantially wider, both at the top and bottom of the tool. This provides room adjacent to each top plate and each bottom plate for a longer, wider pocket knife implement to fit above or below the jaw members when the tool is closed. Shorter and/or narrow implements can be mounted between the longer implements, i.e., in registration with the jaw members, for fitting alongside the jaw members when the tool is closed.

Preferably, the upright webs 84 of the handles have scattered holes 94 to allow water that otherwise would collect in the channels to pass out, and to permit ventilation and evaporation.

The geometry of the preferred tool 71 is identical to the geometry of the first-described embodiment, that is, the relative positions of the center jaw pivot, link pivots, and handle pivots are the same. Consequently, the same mechanical advantage is achieved. The jaw members move through a smaller angle than the handles; and, in the closed position, the working end portions 75 of the jaw members abut, with the jaw members fully nested within the handles, and with the inner edges of the handles in engagement, as illustrated for the first-described embodiment of the invention in FIG. 2.

With the handles 77 swung to their open positions, the working end portions of the jaw members engage when the handles still are at a small angle relative to each other, so that a strong grasping force can continue to be applied. Alternatively, the grasping action of the jaw members can be obtained when the handles are swung past their open-most positions toward their closed positions, i.e., the approximate positions shown in FIG. 18. In that case, one handle can rest on a supporting surface while the other handle is forced toward the supporting surface to achieve a strong grasp. The long, straight, flat webs of the handles help to steady the tool in this position for convenience and safety.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A tool comprising:

a pair of opposed jaw members;

a first pivot swingably connecting said jaw members for movement relative to each other, each of said jaw members having a working end portion extending from said first pivot in a first direction for cooperation of said working end portions by relative movement to closed positions of said jaw members, each of said jaw members further having a butt portion extending from said first pivot in a second direction generally opposite the first direction;

two elongated handles, each of said handles having a top plate aligned with the top plate of the other of said handles, a bottom plate aligned with the bottom plate of the other of said handles and a web connecting corresponding edge portions of said top and bottom plates to define an open channel between said top and bottom plates, said jaw members, including said working end portions and said butt portions, lying between said top plates and said bottom plates;

two second pivots swingably connecting said jaw butt portions to said handles, respectively, between said top and bottom plates of the respective handles for swinging of each handle through an angle approaching 180° relative to the jaw member to which such handle is swingably connected between closed positions of said handles in which said working end portions of said jaw members are received in said channels and open positions of said handles in which said working end portions of said jaw members project from said handles, each of said handles having a forward end portion extending from the second pivot of such handle generally toward the jaw to which such handle is connected and a rear portion extending from such second pivot in a direction generally opposite the direction of extension of the corresponding forward portion;

a link having opposite end portions;

two third pivots swingably connecting said opposite end portions of said link, respectively, to said forward end portions of said handles at locations overlying the jaw butt portions and between said first pivot and said second pivots when said handles are in the open positions, such that swinging of said handles relative to each other through a first angle effects swinging of said working end portions of said jaws relative to each other through a second angle smaller than the first angle for a compound leverage effect; and means interconnecting said forward end portions of said handles for effecting simultaneous swinging of both handles through equal angles, said interconnecting means including interdigitated projections formed on the forward end portions of the aligned plates of said handles out of registration with said jaw butt portions so as not to interfere with swinging of said jaw butt portions relative to said handles, said web portions of said handles being elongated and flat, said top and bottom plates of said handles having straight inner edge portions, and said first, second and third pivots being disposed to position said handles such that said straight inner edge portions of said top and bottom plates are closely adjacent in the closed positions of said handles for substantially completely enclosing said jaw members within said channels of said handles and such that said handles diverge from each other at a small acute angle when said handles are in the open positions and said jaw members are in the cooperating closed positions.

2. The tool defined in claim 1, in which the handle top plates lie in a first common plane and the handle bottom plates lie in a second common plane, said first and second common planes being parallel and spaced apart, the jaw members including the working end portions and the butt portions lying between said first and second planes.

3. The tool defined in claim 1, in which the working end portions of the jaws are exposed for use when the handles are located between their closed positions and a position midway between the closed positions and the open positions, for resting of one of the flat handle webs on a supporting surface when the handles are swung toward their closed positions such that the tool may be used by cooperation of the working end portions of the jaw members as the handles are moved toward their closed positions.

4. The tool defined in claim 1, in which the forward end portions of the handle top and bottom plates converge in the area of the third pivots.

5. The tool defined in claim 4, including a plurality of pocket knife implements, and means mounting said implements in the channels of the handles for moving into and out of the channels closely adjacent to the top and bottom plates while leaving room for nesting of the working end portions of the jaw members between selected pocket knife implements in the channels of the handles when the handles are in the closed positions.

* * * * *